United States Patent [19]

Johnson

[11] 4,153,327

[45] May 8, 1979

[54] CONNECTOR FOR TELEPHONE CORDS

[75] Inventor: David W. Johnson, London, Canada

[73] Assignee: Northern Telecom Limited, Montreal, Canada

[21] Appl. No.: 903,239

[22] Filed: May 5, 1978

[51] Int. Cl.[2] ..... H01R 13/12

[52] U.S. Cl. ..... 339/205

[58] Field of Search ..... 339/91 R, 99 R, 103 M, 339/176 MF, 205

[56] References Cited

U.S. PATENT DOCUMENTS

| | | | |
|---|---|---|---|
| 3,041,575 | 6/1962 | Schneider | 339/205 X |
| 3,117,829 | 1/1964 | Leach | 339/205 X |
| 3,474,389 | 10/1969 | Nagano | 339/205 X |
| 3,548,367 | 12/1970 | Bruetsch | 339/205 |
| 4,010,998 | 3/1977 | Tolnar et al. | 339/91 R |
| 4,047,787 | 9/1977 | Gumb et al. | 339/154 A |

*Primary Examiner*—Joseph H. McGlynn
*Assistant Examiner*—John S. Brown
*Attorney, Agent, or Firm*—Sidney T. Jelly

[57] ABSTRACT

The invention is to a connector for connecting end-to-end line cords of telephone sets, to provide for joining standard lengths of line cord to give increased mobility to telephone sets where miniature plugs and jacks are used. The connector is double ended, having a central body member with conductors extending longitudinally in grooves in a lower surface, the conductors bending up and over the top surface, the conductor ends extending inwards towards each other. A top member fits over the top of the central member and has comb-like members for aligning the ends of the conductors. A cover fits over the bottom of the central member, and at each end of the connector is an aperture profiled to accept a miniature plug, the contacts on the plug contacting ends of the conductors.

6 Claims, 3 Drawing Figures

CONNECTOR FOR TELEPHONE CORDS

This invention relates to connectors for telephone wires, and particularly to connectors for connecting end-to-end telephone line cords, having modern miniature plugs at least at one end.

The present day trend for telephones is to provide a miniature jack at the wall or similar outlet, with a miniature plug on the end of the line cord by which the telephone set can be plugged into the jack. By providing a number of jacks around a premise, a telephone set becomes very mobile. Miniature plugs can also be provided at the telephone set end of the line cord, and also on each end of the handset cord, with appropriate miniature jacks in the telephone set and handset.

The increased mobility has caused problems. Customers may wish to position their telephones at a particular location, but the jack is not conveniently placed. Thus it may be too far away, or behind furniture for example. The present invention provides a connector in which standard lengths of telephone cord can be quickly and easily connected end-to-end, to the length necessary. The telephone set can be effectively unplugged at any connector and thus if an outlet jack is inconveniently positioned, it is not necessary to reach behind or to move out furniture to unplug at the outlet jack, but can be unplugged at a connector, in a more convenient position.

The connector is double ended, having a central body member with conductors extending longitudinally end-to-end, a top member having conductor alignment members, and a cover. At each end is a shaped entry into which a miniature plug can enter, the contacts on the plugs engaging with the longitudinally extending conductors.

The invention will be readily understood by the following description of an embodiment, by way of example, in conjunction with the accompanying drawings, in which.

Figure 1:
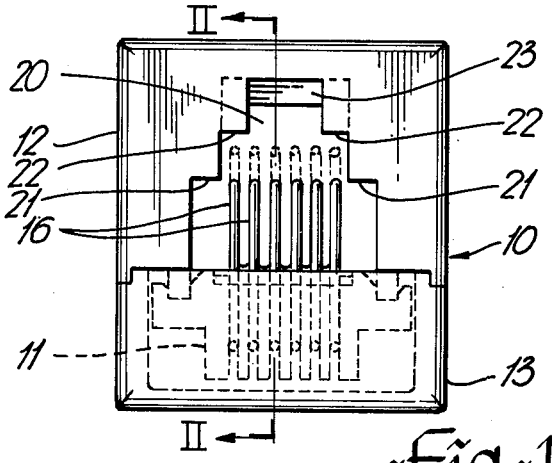
FIG. 1 is a view on one end of a connector.
Figure 2:
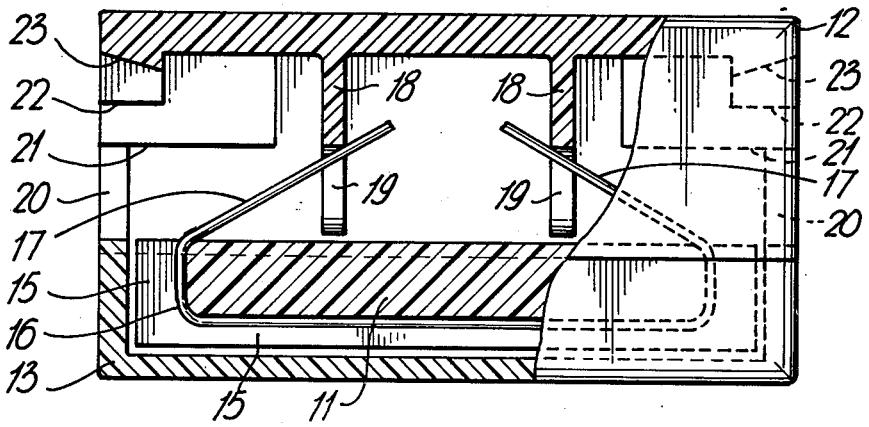
FIG. 2 is a longitudinal cross-section, on the line II—II of FIG. 1.

As illustrated in the drawings, a connector, indicated generally at 10, comprises a central body member 11, a top member 12 and a cover 13. Each of thse parts is molded in plastic material.

The central body member is elongate and has a plurality of grooves 15 extending longitudinally in the lower surface and up each end. In the grooves 15 are positioned conductors 16, for example phosphor bronze wire finished with a hard gold plate. The conductors lie in the grooves 15 and their ends 17 extend upward away from the central body member 11 and have a spring temper.

The top member 12 has two comb shaped members 18 extending laterally across the member and down from the inner surface of the top member. The comb members 18 have slots 19 into which the ends 17 of the conductors 16 are positioned. The slots 19 may be in alignment with the grooves 15, or the grooves 15 may be more widely spaced. The spacing of the slots 19 is the same as the spacing of the grooves containing the contacts in the miniature plugs to be used with the connector.

Figure 3:
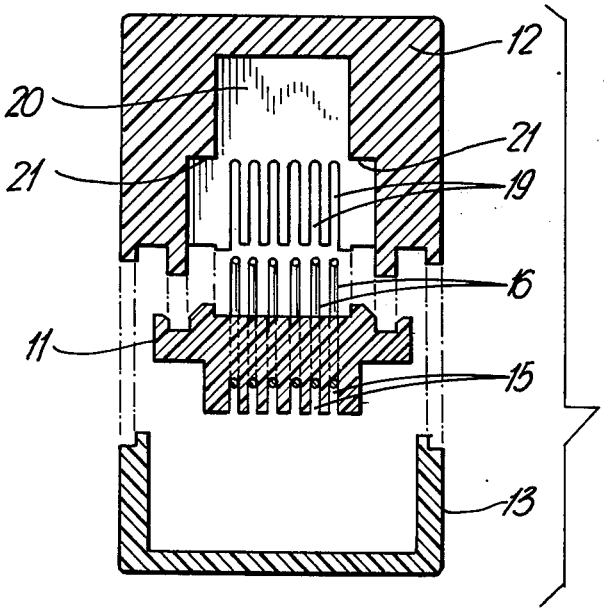
FIG. 3 is an exploded transverse cross-section on the line III—III of FIG. 1, illustrating the three parts of a connector in more detail.

The top member 12 has an entry aperture 20 at each end with a profile to accept a miniature plug. A typical plug is one as described in U.S. Pat. No. 3,860,316. The form of the profile is seen in FIGS. 1 and 3, being of generally rectangular form as viewed on the end of the connector, with the upper surface stepped, at 21 and 22. This ensures correct insertion of a plug. The plugs have a flexible latch which acts to lock the plug in position, the apertures 20 having small inclined ramps 23 which deflect the latch as a plug is inserted. On full insertion, the latch engages the inner ends of the upper step 22.

As a plug is inserted, the grooves in the plug, in which are positioned contacts, engage with the ends 17 of the conductors 16. The ends 17 are pressed down and slide into the grooves in the plug, making contact with the contacts in the grooves. A plug is inserted at each end of the connector and then there is direct connection via the conductors 16 between the contacts in one plug and the contacts in the other plug.

Instead of using a continuous conductor 16, as shown, it is possible to use springy end parts, corresponding to ends 17, joined by a length of other conductor, for example solid or stranded wire.

What is claimed is:

1. A connector for telephone cords for connecting end-to-end telephone line cords having miniature plugs at least on one end, comprising:

a central body member;

a plurality of conductors extending end-to-end along the lower part of said body member and including end portions extending up and over each end of the body member, ends of the conductors extending part way over a top part of the body member;

a top member fitting over the top part of said central body member and including conductor alignment members for positioning the ends of said conductors;

a cover extending over the lower part of said central body member;

a profiled wall at each end of the connector defining an aperture at each end, each aperture profiled to accept one of said miniature plugs, contacts on said plugs aligned with and engaging with the ends of said conductors on full insertion of said plugs.

2. A connector as claimed in claim 1, said profiled walls forming end walls of said top member.

3. A connector as claimed in claim 1, said central body member including a plurality of grooves formed in a lower surface and extending up each end thereof, at least one groove for each conductor.

4. A connector as claimed in claim 3, said conductor aligning members comprising two parallel spaced apart comb shaped members, a member for each of the conductor ends, each comb member including a plurality of slots, at least one slot for each conductor, said conductor ends positioned in said slots.

5. A connector as claimed in claim 1, said cover enclosing said central body and being attached to said to member.

6. A connector as claimed in claim 1, including spaced apart stepped portions in each aperture and a ramp extending between said stepped portions, whereby on insertion of a plug said ramps deflect a flexible latch member on said plug, said latch engaging behind said stepped portions when the plug is fully inserted.

* * * * *